US005291094A

United States Patent [19]

Lee

[11] Patent Number: 5,291,094

[45] Date of Patent: Mar. 1, 1994

[54] MULTI-FOCUSING TYPE ELECTRON GUN FOR COLOR CATHODE RAY TUBES

[75] Inventor: Sungwoo Lee, Kyunggi, Rep. of Korea

[73] Assignee: Samsung Electron Devices Co., Ltd., Kyunggi, Rep. of Korea

[21] Appl. No.: 836,053

[22] Filed: Feb. 12, 1992

[30] Foreign Application Priority Data

Feb. 12, 1991 [KR] Rep. of Korea ..... 91-2337

[51] Int. Cl.[5] ..... H01J 29/56

[52] U.S. Cl. ..... 313/414; 313/412; 313/460; 313/425

[58] Field of Search ..... 313/414, 412, 413, 425, 313/428, 432, 436, 437, 439, 447, 449, 460, 436, 448

[56] References Cited

U.S. PATENT DOCUMENTS 4,370,592 1/1983 Hughes et al. ..... 313/414

4,728,859 3/1988 Natshuhara et al. ..... 313/414 X 4,833,365 5/1989 Shirai et al. ..... 313/414

*Primary Examiner*—Donald J. Yusko

*Assistant Examiner*—Ashok Patel

*Attorney, Agent, or Firm*—Christie, Parker & Hale

[57] ABSTRACT

In a multi-focusing type electron gun in which first through eighth electrodes and a shield cup are provided, the sixth electrode which forms the center of a second unipotential lens is formed by a primary electrode and a corresponding secondary electrode. The center aperture of the primary electrode has a larger inside diameter than lateral apertures thereof, which is equal to the inside diameter of the lateral apertures of the secondary electrode. The center aperture of the secondary electrode has a comparatively smaller inside diameter than the lateral apertures thereof but which is equal to the inside diameter of the lateral apertures of the primary electrode, so that a voltage difference of the second unipotential lens becomes uniform to obtain an expanded focus lens.

4 Claims, 6 Drawing Sheets

MULTI-FOCUSING TYPE ELECTRON GUN FOR COLOR CATHODE RAY TUBES

FIELD OF THE INVENTION

The present invention relates to a multi-focusing type electron gun for color cathode ray tubes (CRTs) and, more particularly, to a multi-focusing type electron gun in which a uniform voltage difference between unipotential lenses is formed in the neighbourhood of a bipotential lens.

BACKGROUND OF THE INVENTION

Color cathode ray tubes are, as shown in FIG. 4, have a bulb 8 formed by uniting a face plate 4 in which a fluorescent layer 2 is formed on the inside surface of a funnel 6. At the inside of a neck portion of bulb 8, there is received an electron gun 10 which emits R,G,B electron beams 12. The beams pass through apertures of a shadow mask 14 and then strike fluorescent layer 2 to form a picture element on a screen. A deflection yoke 16 disposed on the outside surface of the funnel 6 deflects the beams to form the picture on the screen.

The inline type electron gun for such color cathode ray tubes has advantages of being easily manufactured due to the simple structure in which R,G,B electron beams are transversely arranged in a line and omitting vertical dynamic convergence. However, this gun has the disadvantage of having serious spherical aberration of a focus lens for focusing the electron beams.

To reduce spherical aberration, it is well known that greater spacing between a pair of electrodes forming the focus lens creates an expanded focus lens. In this case, the greater the spacing between the pair of electrodes forming the focus lens, the smaller the spherical aberration is. However, when the spacing therebetween is excessively great, static electric charge generated from the periphery of the neck portion has influence on the focus lens to cause the electron beams misconvergence, which severely restricts the expanded focus lens of the inline type electron gun.

Thus, attempts at forming the expanded focus lens have been continued. One of them is described in U.S. Pat. No. 4,370,592 "Color Picture Tube having an Improved Inline electron Gun with an Expanded Focus Lens", issued to Richard H. Hughes on Jan. 25, 1983. FIG. 9 shows the main focus lens structure of the inline type electron gun provided in the U.S. Pat. No. 4,370,592. The electron gun of such method has R,G,B apertures $18_R$, $18_G$, $18_B$, $20_R$, $20_G$, $20_B$ which are included in a pair of electrodes 18,20, facing each other and has a horizontal lens 22,24 which is formed by deep drawing at a predetermined depth from the opposing side of the two electrodes 18,20 at their peripheries, thereby, in practice, forming the expanded main focus lens without the influence of external static charge. The width of both horizontal lenses 22,24 is, in practice, determined by the lateral width D of the third electrode 18 and by the lateral width E of the fourth electrode 20. While the lateral width D,E is severely restricted by the inside diameter of the neck portion of the color cathode ray tube (CRT), in a practical manufacturing process, it is much restricted by the distance A between the axes of each aperture. That is, while the horizontal lens 22,24 can be used in a SS(small separation) type of 5.08 mm or in a MS(middle separation) type of 5.5–5.6 mm, it can not be used in a LS(large separation) type of more than 6.6 mm.

The reason for not applying the horizontal lens to the LS type will be described with reference to FIG. 6, which is a plan view of the fourth electrode 20. Each R,G,B electron beam $E_R$,$E_G$,$E_B$ which pass through each aperture $20_R$,$20_G$,$20_B$ thereof is positioned at the center thereof. However, when the distance A between the axes of each aperture is more than 6.6 mm, the respective distance from the two side apertures $20_R$,$20_B$ to the two ends of the horizontal lens 24 becomes different from each other, whereby each horizontal focusing voltage between the central aperture the two side apertures is different.

The reason for the horizontal focusing voltage difference above is that the side apertures $20_R$, $20_B$ are nearer the electrode 20 than the central aperture $20_G$, whereby the side apertures have higher potential than the center aperture. For the same reason as above, the two side apertures $20_R$,$20_B$ have a partial or local difference between the horizontal and vertical focusing voltage, whereby the picture element formed on the screen is distorted.

To solve such problems caused by the expanded focus lens as described above, the multi-focusing type electron gun of a uni-uni-bipotential lens arrangement as shown in FIG. 7 has been used in practice. Such electron gun is formed such that a cathode K, an electrode assembly formed by first to eighth electrodes 26 to 40, and a shield cup 42 are successively arranged. A screen voltage Vs of 0–1 Kv is applied to the second, fourth and sixth electrode 28,32,36, a focus voltage Vf of 0–10 Kv is applied to the third, fifth and seventh electrodes 30,34,38, a voltage of 0––100 Kv is applied to the first electrode 26 and 0–30 Kv high voltage is applied to the eighth electrode 40 and the shield cup 42. Accordingly, the third, fourth and fifth electrode 30,32,34 form a unipotential lens SL1, the fifth, sixth and seventh electrode 34,36,38 form a second unipotential lens SL2 and the seventh and eighth 38,40 form a bipotential lens ML.

The uni-uni-bipotential type electron gun can optically be explained with reference to FIG. 8, wherein a solid line indicates that the first emitting angle $\theta_1$ of the electron beam becomes small when the first unipotential lens SL1 is larger than the second unipotential lens SL2. As a result, since the electron beam which passes through the first lens centrally enters the axis of the second lens, the second emitting angle $\theta_2$ becomes relatively small for the beam to have a comparatively small inside diameter r. By contrary, a dotted line reveals that, since the first emitting angle $\theta_1$, becomes large when the first lens SL1' is formed less weakly than the second lens SL2', the beam enters the surroundings of the second unipotential lens SL2. Accordingly, even when the second emitting angle $\theta_2'$ of the beam becomes small, the beam has a comparatively large inside diameter r'. Further, the diameter of the two unipotential lenses SL1,SL2 is determined by the spacing between the opposing electrodes so that, when the second lens is expanded, static charge generated from the neck portion has serious influence thereon to reduce picture quality.

Thus, the first unipotential lens of a conventional multi-focusing type electron gun is formed with a larger diameter than the second lens so that the beam has a small inside diameter. However, even in such a gun, problems arise when distribution of equipotential formed in each aperture of the sixth electrode 36, which is the center of the second unipotential lens SL2 is examined.

FIG. 9 explains distribution of equipotential of the second unipotential lens SL2 formed at the aperture inside of the sixth electrode 36 of the multi-focusing electron gun of FIG. 7. Bordering each aperture inside the sixth electrode 36 to which the relatively low voltage is applied, equipotential lines are formed of a bobbin type in which the middle part is depressed, so a gap L formed at a symmetrical point becomes very narrow to hinder keeping the voltage difference uniform.

Accordingly, picture quality of color cathode ray tubes can be much improved when the second unipotential lens SL2 is not influenced by static charge generated from the neck and voltage difference thereof is kept uniform.

SUMMARY OF THE INVENTION

According to one aspect of the present invention, a multi-focusing type electron gun includes a uni-uni-bipotential lens for color cathode ray tubes in which two unipotential lenses have expanded focus lenses such that the second unipotential lens has a uniform voltage difference and/or is not influenced by static charge generated from a neck portion.

To achieve such feature, the sixth electrode, which forms the center of the second unipotential lens comprises a prearranged or near or proximal electrode and a corresponding postarranged or far or distal electrode in which a center aperture of the near electrode has a larger inside diameter than a side aperture thereof and the same inside diameter as a side aperture of the far electrode, and the center aperture of the far electrode has a relatively smaller inside diameter than the side aperture thereof and the same inside diameter as the side aperture of the near electrode, whereby a voltage difference of the second unipotential lens becomes uniform, even when the focus lens is expanded.

BRIEF DESCRIPTION OF THE DRAWINGS

Further features and other advantages of the present invention will be apparent from the following detailed description in connection with the accompanying drawings, in which.

DETAILED DESCRIPTION

Figure 1:
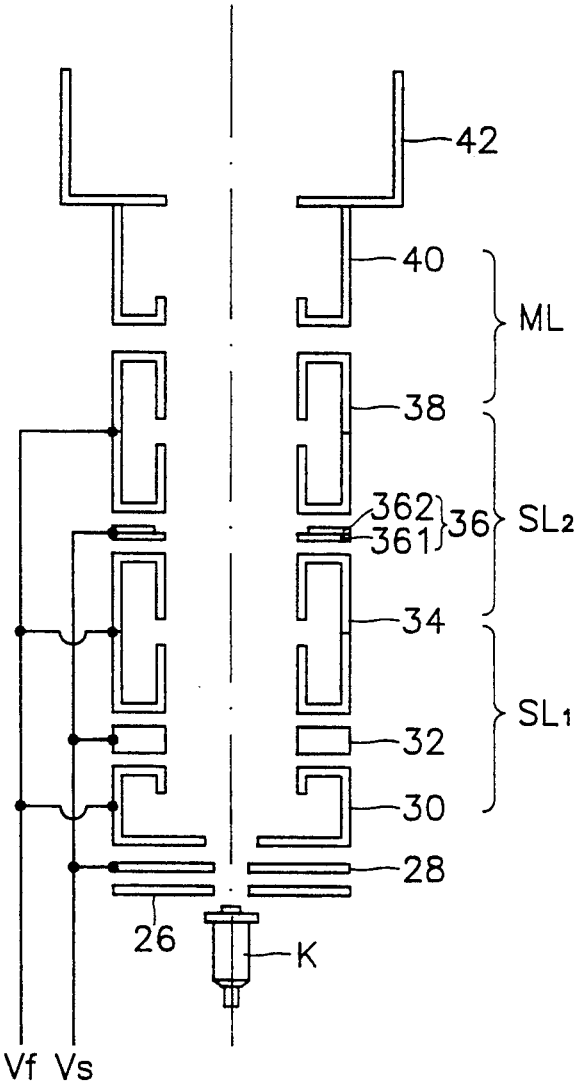
FIG. 1 is a schematic view of an electrode arrangement of a multi-focusing electron gun.

FIG. 1 illustrate an electrode arrangement of the present invention in which a cathode K, first to the eight electrodes 26 to 40, and a shield cup 42 are successively arranged at a predetermined distance. A screen voltage Vs of 0–1 Kv is applied to the second, fourth and sixth electrode 28,32,36, a 0–10 Kv focus voltage Vf is applied to the third, fifth and seventh electrode 30,34,38 and a 0–30 Kv high voltage is applied to the first and eighth electrode 26,40 and the shield cup 42.

The wire connection of the third, fourth and fifth electrodes 30, 32, 34 forms the first unipotential lens; that of the fifth, sixth, and seventh electrodes 34, 36, 38 forms the second unipotential lens; and that of the seventh and eighth electrodes 38, 40 forms a bipotential lens, so that a main focus lens of such electron gun is a uni-uni-bipotential lens.

Figure 2A:
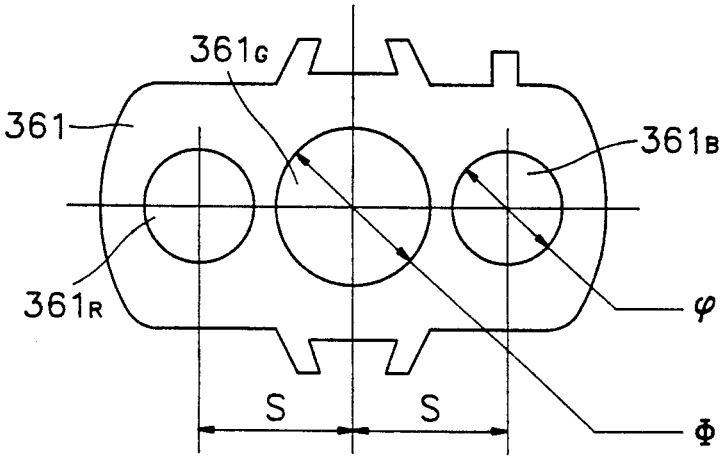
FIG. 2A is a front view of the sixth electrode of the present invention.
Figure 2B:
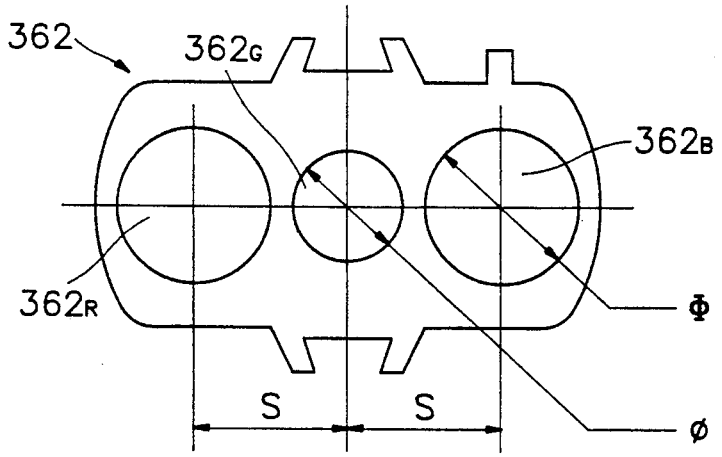
FIG. 2B is a front view of an auxiliary of the sixth electrode of FIG. 2A.
Figure 3:
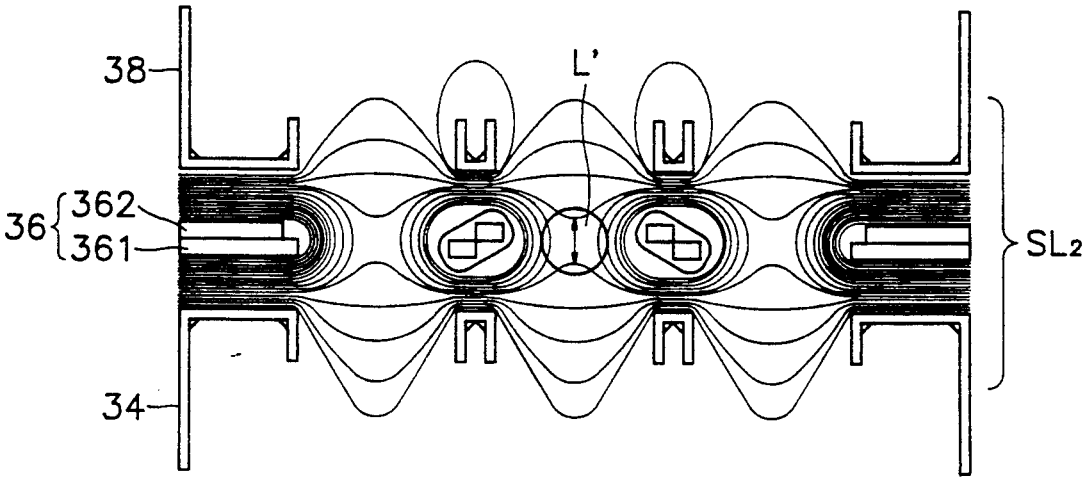
FIG. 3 shows distribution of equipotential of the second unipotential lens of the present invention.

Thus, the third, fourth and fifth electrodes 30,32,34 form a first unipotential lens SL1; the fifth, sixth and seventh electrode 34,36,38 form a second unipotential lens SL2 and; and the seventh and eighth electrodes 38,40 form a bipotential lens ML. When shown from the cathode K, the sixth electrode 36, which forms the center of the second unipotential lens SL2, is formed by positioning a near electrode 361 with a corresponding far electrode 362. As shown in FIG. 2A, the near electrode 361 is formed such that its center aperture $\mathbf{361}_G$ has an inside diameter $\Phi$, which is expanded at a predetermined size, and the side apertures $\mathbf{361}_R$,$\mathbf{361}_B$ have a relatively reduced inside diameter $\phi$ to maintain the same distance S between the axes of each aperture. By contrary, the center aperture $\mathbf{362}_G$ of the far electrode 362 has a relatively reduced inside diameter, and the side apertures $\mathbf{362}_R$,$\mathbf{362}_B$ have a relatively large inside diameter.

Figure 4:
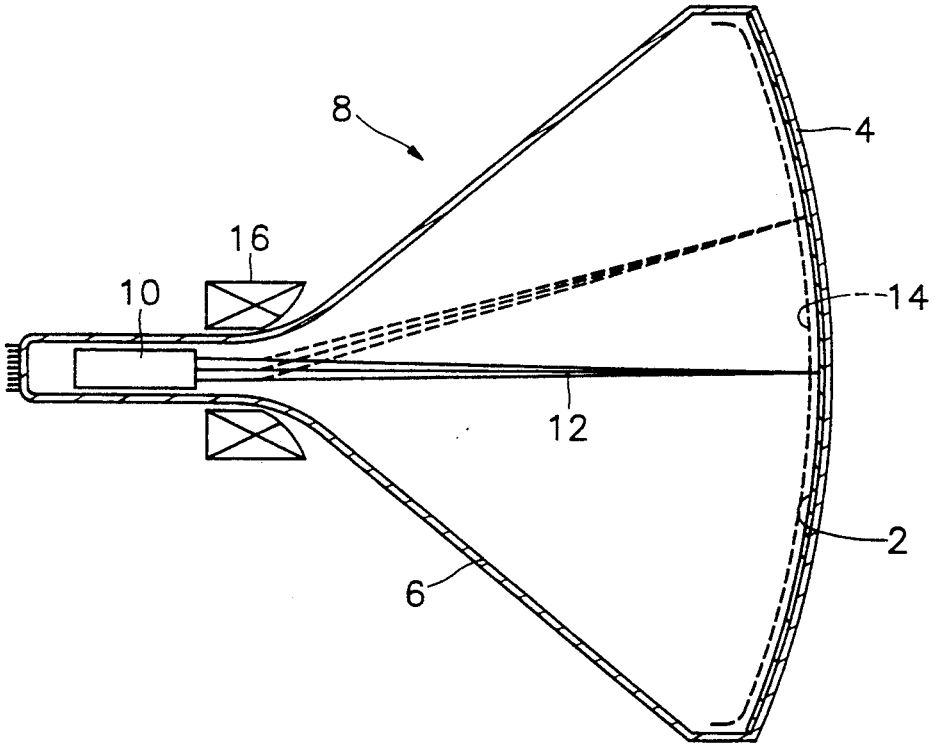
FIG. 4 (Prior Art)
FIG. 4 is a sectional side view of a conventional color cathode ray tube.
Figure 5:
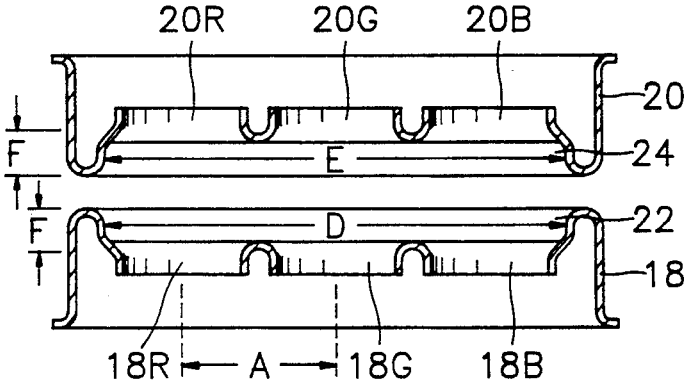
FIG. 5 is a sectional side view of an embodiment of an expanded main focus lens.
Figure 6:
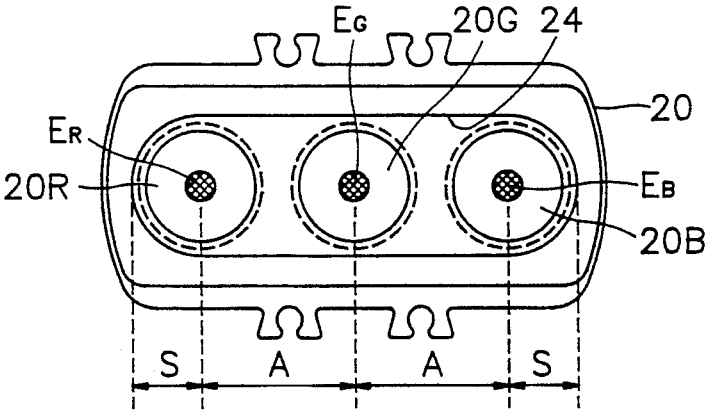
FIG. 6 is a plan view of FIG. 5.
Figure 7:
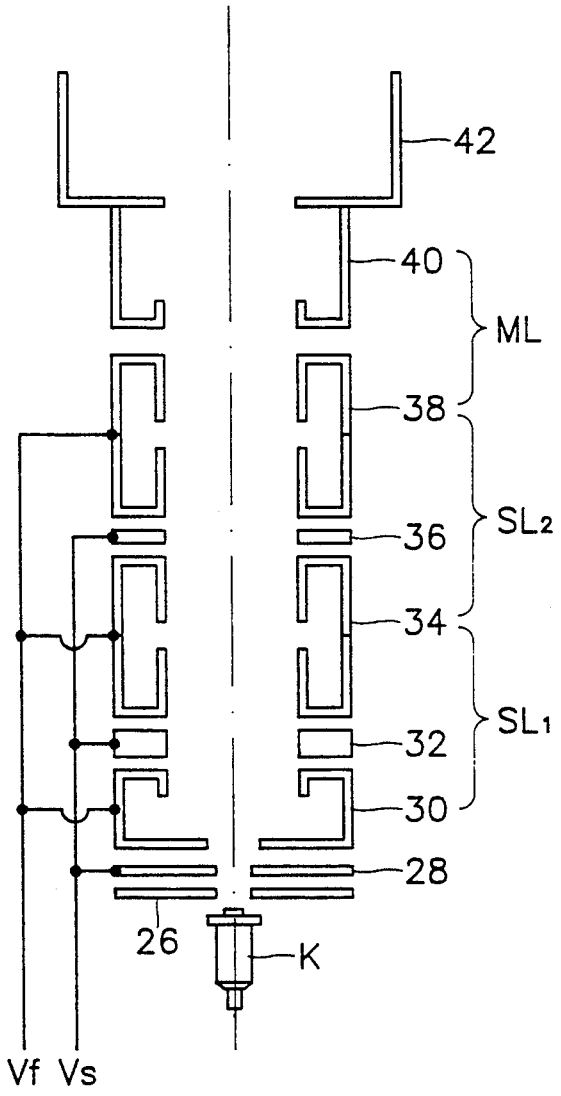
FIG. 7 (Prior Art)
FIG. 7 is a schematic view of an electrode arrangement in a conventional multi-focusing type electron gun.

As described above, in accordance with the symmetrical arrangement of the large and relatively reduced inside diameter $\phi$ having a predetermined size of the center apertures $\mathbf{361}_G$,$\mathbf{362}_G$ and the side apertures $\mathbf{361}_R$,$\mathbf{361}_B$,$\mathbf{362}_R$,$\mathbf{362}_B$, distribution of equipotential at its inside is shown in FIG. 4. That is, a gap L' formed at the border of an equipotential line of the present invention is wider than that of the conventional electron gun. As a result, the voltage difference of the second unipotential lens SL2 formed around the center of the sixth electrode 36 becomes uniform. The relationship between the large inside diameter $\Phi$ and relatively reduced inside diameter $\phi$ and the distance S between the axes of each aperture is represented by the following inequality, at that time when the best efficiency can be obtained:

$$\phi < \Phi \leqq S$$

Figure 8:
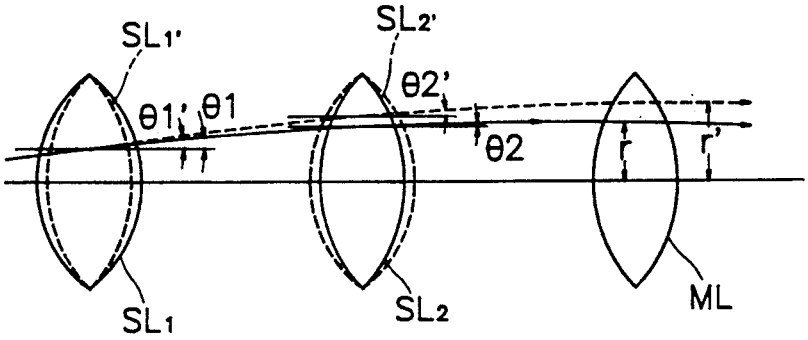
FIG.8 (Prior Art)
FIG. 8 is an explanatory diagram for describing the optical operation of an electron gun of conventional operation to assist in the explanation of the present invention.
Figure 9:
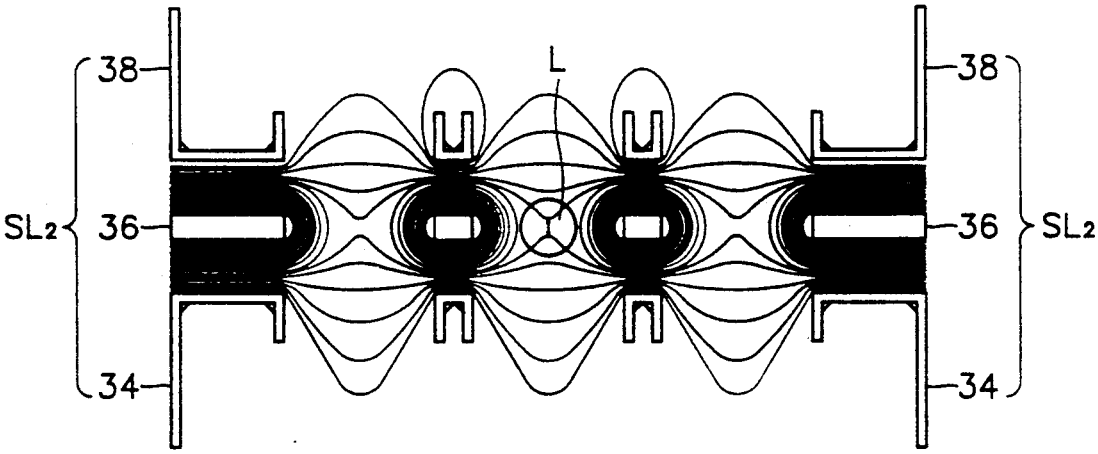
FIG.9 (Prior Art)
FIG. 9 shows distribution of equipotential of the second unipotential lens of an electron gun of FIG. 7.

Thus, as shown in FIG. 8, other than the first unipotential lens SL1 being larger than the second unipotential lens SL2, the electron gun of the present invention has the advantage of improving picture quality of color cathode ray tubes due to realization of two expanded unipotential lenses SL1,SL2.

What is claimed is:

1. In a multi-focusing type electron gun having an electrode assembly for focusing electron beams, the assembly comprising first through eighth electrodes in order starting from a cathode and having a shield cup, wherein the fifth, sixth, and seventh electrodes in sequence form a unipotential lens, the improvement wherein the sixth electrode comprises a primary electrode and a secondary electrode, the primary electrode facing the fifth electrode and the secondary electrode facing the seventh electrode, the primary and secondary electrodes each having three apertures formed therein, the three apertures comprising a central aperture and two lateral apertures, the central aperture of the primary electrode having a larger diameter than a diameter of the lateral apertures thereof, and equal to a diameter of the lateral apertures of the secondary electrode, and the central aperture of the secondary electrode having a comparatively smaller diameter than the diameter of the later apertures thereof, and equal to the diameter of the lateral apertures of the primary electrode, such that a voltage difference of the unipotential lens becomes uniform to thereby obtain an expanded focus lens.

2. The electron gun as claimed in claim 1, wherein a relationship between the diameter of the central aperture of the primary electrode which is represented as $\Phi$ and the diameter of the central aperture of the secondary electrode which is represented as $\phi$, and a distance S between axes of the central apertures to the lateral apertures for the primary and secondary electrodes is represented by the following inequality :

$$\phi < \Phi \leqq S.$$

3. In a multi-focusing type electron gun having an electrode assembly for focusing electron beams, the assembly comprising first through eighth electrodes in order starting from a cathode and having a shield cup, wherein the third, fourth, and fifth electrodes form a first unipotential lens, the fifth, six, and seventh electrodes form a second unipotential lens, and the seventh and eighth electrodes form a bipotential lens, the improvement wherein the sixth electrode comprises a primary electrode on a side facing the fifth electrode and a secondary electrode on a side facing the seventh electrode, the primary and secondary electrodes each having three apertures formed therein, the three apertures of the primary electrode being aligned with the three apertures of the secondary electrode, and the three apertures comprise a central aperture and two lateral apertures, the central aperture of the primary electrode having a larger diameter than a diameter of the lateral apertures thereof, and equal to a diameter of the lateral apertures of the secondary electrode, and the central aperture of the secondary electrode having a comparatively smaller diameter than the diameter of the lateral apertures thereof and equal to the diameter of the lateral apertures of the primary electrode, such that a voltage difference of the second unipotential lens becomes uniform to thereby obtain an expanded focus lens.

4. The electron gun as claimed in claim 3, wherein a relationship between the diameter of the central aperture of the primary electrode which is represented as $\Phi$ and the diameter of the central aperture of the secondary electrode which is represented as $\phi$, and a distance S between axes of the central apertures to the lateral apertures for the primary and secondary electrodes is represented by the following inequality :

$$\phi < \Phi \leqq S.$$

* * * * *